US005695438A

United States Patent [19]

Bjørnsti

[11] Patent Number: 5,695,438

[45] Date of Patent: Dec. 9, 1997

[54] TRAINING APPARATUS

[76] Inventor: Yngve Bjørnsti, 8650 Mosjøen, Sjamo, Norway

[21] Appl. No.: 428,236

[22] PCT Filed: Oct. 27, 1993

[86] PCT No.: PCT/NO93/00159

§ 371 Date: Jul. 31, 1995

§ 102(e) Date: Jul. 31, 1995

[87] PCT Pub. No.: WO94/09853

PCT Pub. Date: May 11, 1994

[30] Foreign Application Priority Data

Oct. 28, 1992 [NO] Norway ..... 924149

[51] Int. Cl.[6] ..... A63B 26/00

[52] U.S. Cl. ..... 482/144; 482/145

[58] Field of Search ..... 482/144, 142, 482/143, 145

[56] References Cited

U.S. PATENT DOCUMENTS 3,286,708 11/1966 Gartner ..... 482/144
3,519,268 7/1970 McQueen ..... 482/144
4,703,929 11/1987 Reed ..... 482/144

FOREIGN PATENT DOCUMENTS 2645478 4/1978 Germany .
2803404 8/1979 Germany .
3221721 12/1983 Germany .

*Primary Examiner*—Lynne A. Reichard
*Attorney, Agent, or Firm*—Morrison & Foerster LLP

[57] ABSTRACT

An apparatus for training muscles of the back, abdomen, arms, neck and shoulders, consisting of two equally dimensioned parallely disposed and coaxial rings (1) which are fixedly connected with a support frame (2) and a U-shaped swing (4) with a foot rest (7) and a locking device (23, 24) to support the feet of the user. A fixing device (15–21, 25–28) for the waist of the user is arranged close to the axis of rotation of the swing. In use, the rings (1) serve as a handrail. The swing is adjustable in length. The fixing device for the waist of the user consists of a back support (16) and a front support (15) on each side of the rotational axis of the swing. The distance of the back support and front support to the axis of rotation is adjustable, so that the user may be strapped in such a way that his center of gravity will be kept near the axis of rotation of the swing.

13 Claims, 2 Drawing Sheets

TRAINING APPARATUS

TECHNICAL FIELD

The present invention relates to a training and stretching apparatus for the muscles of the back, abdomen, arms, shoulders and neck. Lack of physical exercise often causes physical and mental problems. Accordingly, an increasing number of people are experiencing physical problems related to insufficient muscle strength. Back pain, for example, is a common problem. To avoid this illness it is important that the abdominal muscles provide good support for the back. The present invention seeks to provide a training apparatus that strengthens muscles and thereby prevents such problems and also treats people that suffer from these illnesses.

BACKGROUND ART

German patents No. 2803404 and 3221721 disclose therapy devices in the field of the present invention. The devices consist of a support frame and a body support board rotatably connected to the support frame. The rotatable connection of the body support board is located below the middle part of the board, which is located behind the back of the user. Thus, the prior art devices are not designed for a 360° rotation of the user. Also, since the user's center of gravity is outside the rotational axis of the apparatus, the user will not be able to rotate the support board by himself. Furthermore, the board prevents free movement of the upper body.

DISCLOSURE OF THE INVENTION

According to the present invention, the swing includes a telescopically adjustable foot rest, a front pad for the abdomen and a back pad for the back. The foot rest, front pad and back pad are adjusted such that the center of gravity of the user's body coincides with the rotatable axis that is attached to the support frame. The user is free to rotate and will easily be able to move to a desired position by using the handrails. The user may rotate in a circle of 360° and the swing can be locked in any position by a bolt. When the swing is locked with the user in a supine position, the apparatus will function as an excellent exercise device for the abdominal muscles. When the user is rotating and also when he is hanging freely in an upright position, he will be able to completely relax and the back muscles will be stretched in such a way that the vertebral discs will be realigned. This results in improved blood circulation and relieves pressure on pinched nerves. This important exercise is not possible with the body support board of the prior art because the board restricts movement of the shoulders and head. The swing of the present invention may be adjusted in such a way that the user will be able to easily rotate to any position without help from others.

As previously mentioned, the swing can be rotated in 360° and during such a rotation the weight of the body is supported by the front and back pads. Accordingly, the pads will act as a massage device which also has a good effect on the muscles. This effect is not achieved to the same extent with the support boards of the prior art.

METHODS OF CARRYING OUT THE INVENTION

Figure 2:
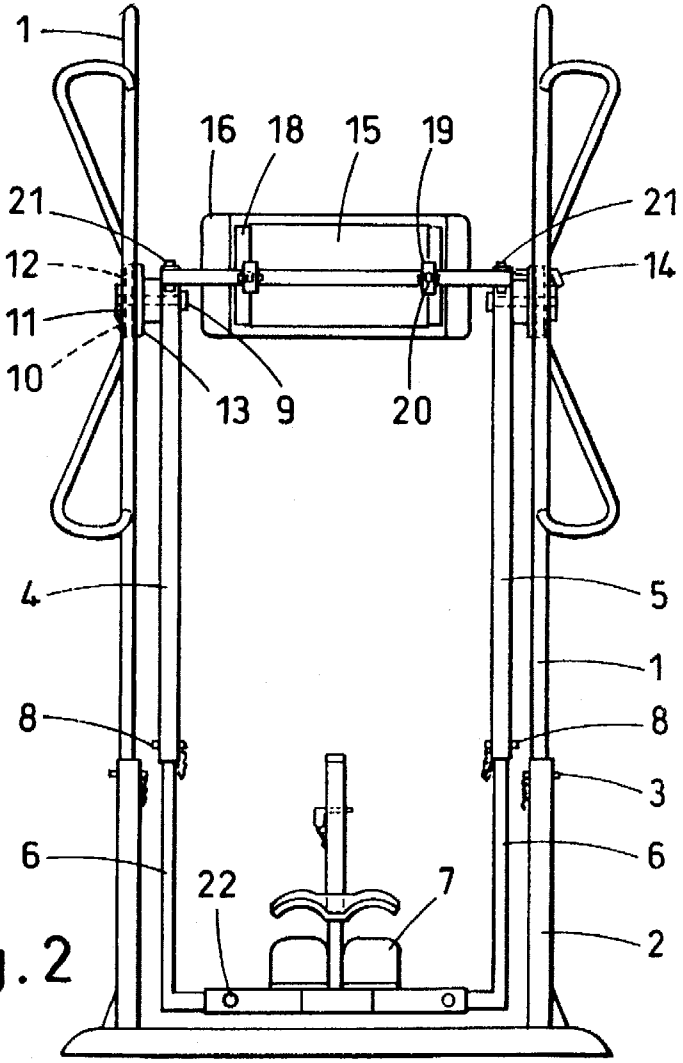
FIG. 2 is a front view of the training apparatus.

With reference to the drawings 1–4, the training apparatus comprises the following main components: A support frame 1 including two circular rings (handrails) and optionally, at least two support rods radially attached to said circular rings. Support frame 1 is provided with a U-frame 2 that is telescopically fitted to frame 1 by inserting a bolt 3 through openings 3 of support frame 1 and U-frame 2. A U-shaped swing 4, having an upper frame 5 and a lower telescopically adjustable U-frame 6 and adjusting bolts 8, 22, is rotatably connected to support frame 1 by bearings 10 and bolts 9. U-frame 6 is provided with a footrest 7 which includes an adjustable locking device 23 and a bolt 24. A front pad 15 and a back pad 16 are mounted to frame 5.

Figure 1:
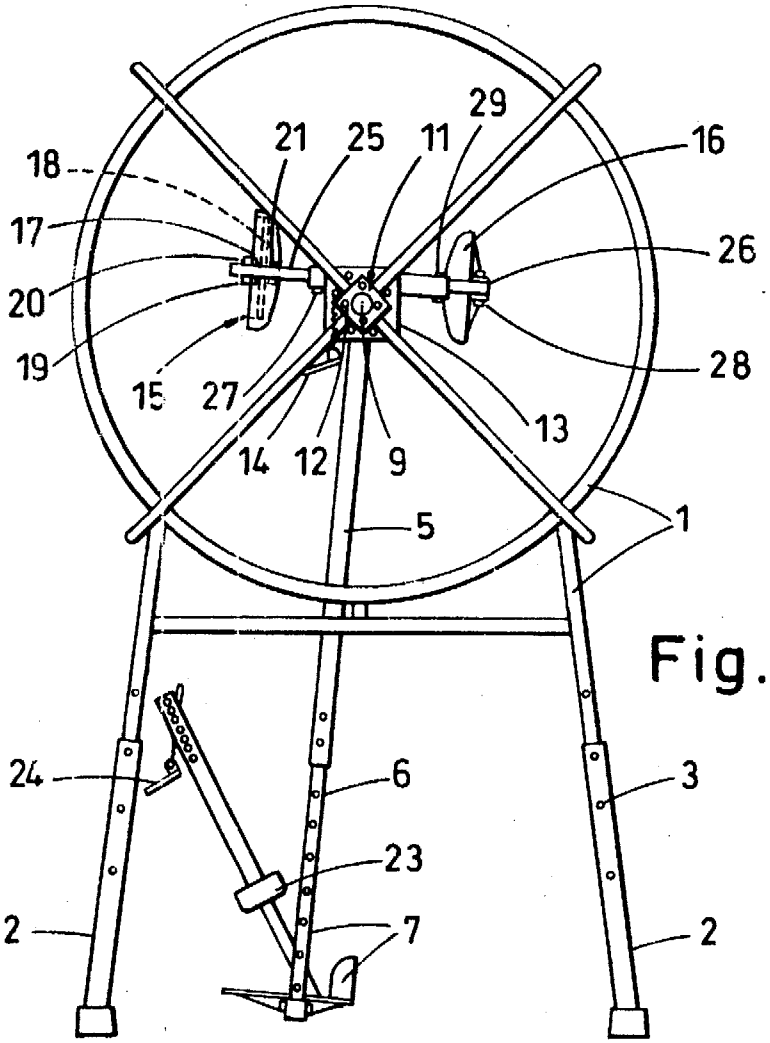
FIG. 1 is a side view of the training apparatus.
Figure 4:
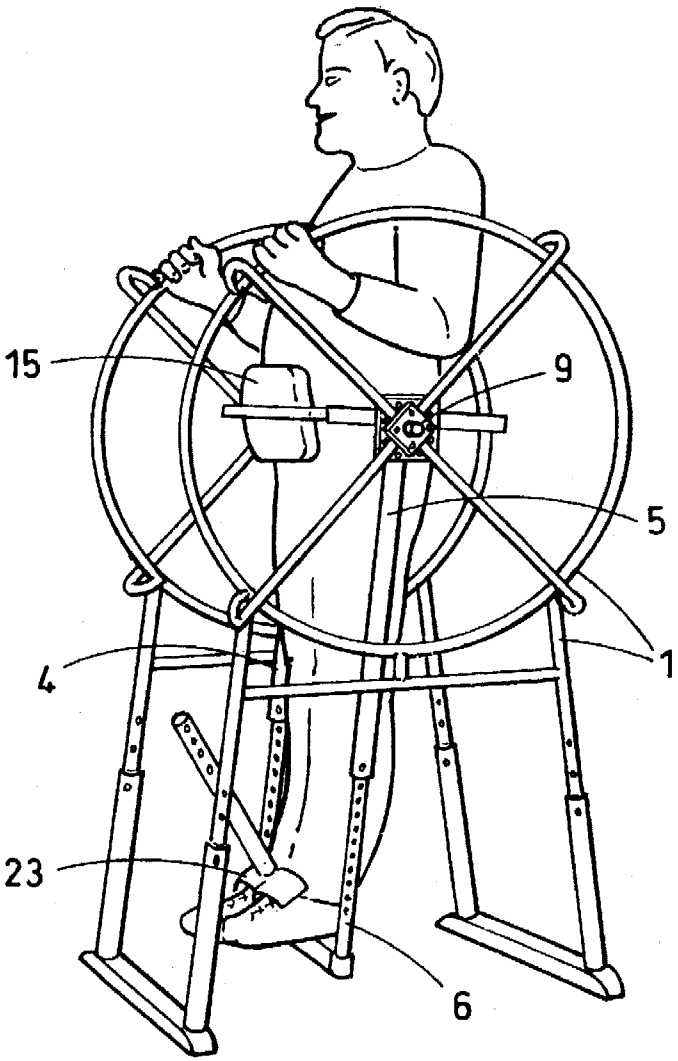
FIG. 4 shows a person using the training apparatus.
Figure 3:
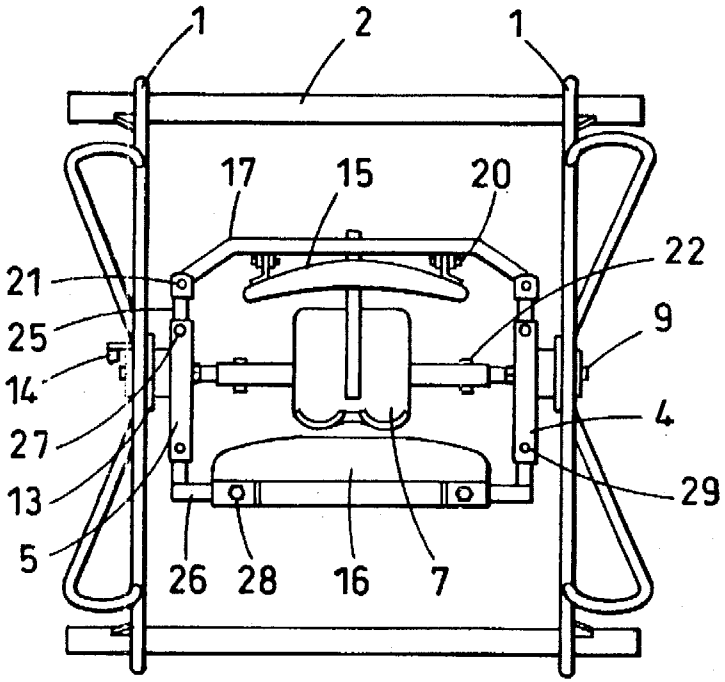
FIG. 3 is an overhead view of the training apparatus.

In addition, the apparatus shown in FIGS. 1–4 includes the following items: A plate 11 for keeping bearings 10 in place, screws 11 which connect plate 11 to a center plate 13, which is attached to the support rods (inside the handrails) of support frame 1. A pin 14 may be inserted through openings in a center plate 14 and frame 5 for locking swing 4 in a desired position. A holding plate 18 for front pad 15 is connected to a steel frame 17 through a holding device 19 that includes a pin 20 that allows horizontal rotation of front pad 15. A pin 21 allows front pad 15 and frame 17 to swing open for entry and exit of the user. A U-frame 26 which supports back pad 16 through a connecting pin 28, and an adjusting pin 29 for telescopic connection with upper frame 5. A rod 25 including a pin 27, wherein said rod connects frame 17 to swing 4, allowing for adjustment of front pad 15.

EXAMPLE 1

Use of the Training Apparatus

Initially swing 4 will be locked in a vertical position and front pad 15 will be in an open position. After the user has entered swing 4, his feet will be held to the footrest by adjustable locking device 23. Then front pad 15 including frame 17 will be moved against the abdomen of the user and locked into position by bolt 21. To unlock swing 4, the user pulls out locking pin 14. The user may rotate in a controlled manner by gripping the handrails. Swing 4 may be locked so that the user is in a supine position. By twisting the shoulders from side to side, the user will exercise his abdominal and back muscles. For exercising the muscles of the back, swing 4 may be rotated 180° such that the user is in a prone position where his abdomen is resting on the front pad 15. In an upright position, twisting the shoulders will provide an excellent stretch for the muscles of the upper body. The apparatus may be utilized in numerous other ways, and swing 4 and pads 15, 16 are adjustable to fit people of all sizes.

I claim:

1. An apparatus for training muscles of the back, abdomen, arms, neck and shoulders, comprising:

a support frame having an upper portion and a lower portion;

two equally dimensioned, parallely disposed and coaxial rings, wherein said rings function as a handrail and are fixedly connected to said upper portion of said support frame;

a U-shaped swing having an upper portion and a lower portion, wherein said upper portion of said swing is rotatably attached to said support frame at the center of said rings;

a foot rest having a locking device to secure the feet of the user, wherein said footrest is fixed to said lower portion of said swing;

a fixing device for the waist of the user comprising a front support, a back support and a means for adjusting the distance of said back support to said axis of rotation, wherein said fixing device is attached to said swing near the rotational axis of said swing; and a means for adjusting the distance of said fixing device to said axis of rotation, wherein said means for adjusting is used to position the center of gravity of a user of said apparatus into said axis of rotation.

2. Apparatus according to claim 1, characterised in that the height of the support frame is adjustable, since the upper part (1) of the support frame telescopically fits into the lower part (2) of the support frame, and the frame parts (1, 2) are locked to each other by bolts (8) which are installed in corresponding adjusting holes in the frame parts (1, 2).

3. Apparatus according to claim 1, characterised in that the swing (4, 5, 6) can be fixedly locked in desirable angle positions, since a bolt (14) is installed in a hole in the centre plate (13) and holes in ears which are fixed to the frame part (5).

4. Apparatus according to claim 1, characterised in that the swing (4, 5, 6) is adjustable in the lengtwise direction, since the lower U-formed part (6) of the swing telescopically fits into the upper frame part (8) of the swing, which arm parts (6, 8) are fixedly locked with a bolt (22) which are installed in the corresponding holes in the respective frame parts.

5. Apparatus according to claim 1, characterised in that foot rest (7) is provided with a fixed rod part which has an external and telescopically arranged adjustable tightening part (23) which parts are locked to each other by a bolt (24) which is installed through the holes in the respective parts.

6. Apparatus according to claim 1, characterised in that the distance of the front support (15, 17–20) to the axis of rotation is adjustable by inserting bolts (27) through holes in the telescopic connection between the frame part (5) of the swing and the frame part (25) of the front support.

7. Apparatus according to claim 1, characterised in that the rings (1) are connected to the support frame (2) by four rods respectively which further are connected to the centre plate (13).

8. An apparatus for training muscles of the back, abdomen, arms, neck and shoulders, comprising:

a support frame having an upper portion and a lower portion;

two equally dimensioned, parallely disposed and coaxial rings, wherein said rings function as a handrail and are fixedly connected to said upper portion of said support frame;

a U-shaped swing having an upper portion and a lower portion, wherein said upper portion of said swing is rotatably attached to said support frame at the center of said rings;

a foot rest having a locking device to secure the feet of the user, wherein said footrest is fixed to said lower portion of said swing;

a fixing device for the waist of the user comprises a front support, a back support and a means for adjusting the distance of said back support to said axis of rotation, wherein said fixing device is attached to said swing near the rotational axis of said swing;

a means for adjusting the distance of said fixing device to said axis of rotation, wherein said means for adjusting is used to position the center of gravity of a user of said apparatus into said axis of rotation; and a means for adjusting the distance of said front support to said axis of rotation.

9. An apparatus according to claim 8, wherein the height of said support frame is telescopically adjustable.

10. An apparatus according to claim 8, further comprising a means for locking said swing into position.

11. An apparatus according to claim 8, further comprising a means for telescopically adjusting the length of said swing.

12. An apparatus according to claim 8, further comprising a means for telescopically adjusting said locking device, wherein said locking device secures the feet of a user to said foot rest.

13. An apparatus according to claim 8, further comprising at least two rods and a center plate, wherein said center plate is fixed to said support frame near the center of said rings and said support rods are connected to said circular rings by said center plate.

* * * * *